US007500571B2

(12) United States Patent
Hawkinson

(10) Patent No.: US 7,500,571 B2
(45) Date of Patent: Mar. 10, 2009

(54) APPARATUS FOR HOLDING AND FEEDING PRODUCT

(76) Inventor: Terry Hawkinson, 7804 Riverside Dr. #R7, Parker, AZ (US) 85344

( * ) Notice: Subject to any disclaimer, the term of this patent is extended or adjusted under 35 U.S.C. 154(b) by 331 days.

(21) Appl. No.: 11/196,898

(22) Filed: Aug. 4, 2005

(65) Prior Publication Data

US 2007/0029270 A1 Feb. 8, 2007

(51) Int. Cl.
*A47F 7/00* (2006.01)

(52) U.S. Cl. ..... 211/59.3

(58) Field of Classification Search ..... 211/59.3, 211/184, 189, 74, 59.2, 126.1; 312/61, 71, 312/35

See application file for complete search history.

(56) References Cited

U.S. PATENT DOCUMENTS 4,836,390 A * 6/1989 Polvere ..... 211/59.3
4,901,869 A * 2/1990 Hawkinson et al. ..... 211/59.3
5,638,963 A * 6/1997 Finnelly et al. ..... 211/59.3
5,839,588 A * 11/1998 Hawkinson ..... 211/59.3
6,227,385 B1 * 5/2001 Nickerson ..... 211/59.3
6,382,431 B1 * 5/2002 Burke ..... 211/59.3
6,622,874 B1 * 9/2003 Hawkinson ..... 211/59.3
6,772,888 B2 * 8/2004 Burke ..... 211/59.3
6,886,699 B2 * 5/2005 Johnson et al. ..... 211/59.3
2006/0049122 A1 * 3/2006 Mueller et al. ..... 211/59.3
2006/0186066 A1 * 8/2006 Johnson et al. ..... 211/59.3
2007/0068885 A1 * 3/2007 Busto et al. ..... 211/59.3
2007/0170127 A1 * 7/2007 Johnson ..... 211/59.3

* cited by examiner

*Primary Examiner*—Jennifer E. Novosad
(74) *Attorney, Agent, or Firm*—Parsons & Goltry; Michael W. Goltry; Robert A. Parsons

(57) ABSTRACT

Apparatus for holding and feeding product includes a) a tray having a front end, b) a sidewall clip, carried by a first extremity of a sidewall, attached to the front end of the tray, c) a paddle clip attached to the front end of the tray, d) a third elongate abutment clip, carried by an abutment, attached to the first and paddle clips, e) a paddle mounted to the tray for reciprocal movement in opposition to the abutment, and f) a spring coupling the paddle clip to the paddle and biasing the paddle toward the abutment.

20 Claims, 11 Drawing Sheets

APPARATUS FOR HOLDING AND FEEDING PRODUCT

FIELD OF THE INVENTION

This invention relates to apparatus and methods for storing, displaying and feeding product at points of sale and points of use.

BACKGROUND OF THE INVENTION

Shelf space is premium real estate in retail stores and supermarkets and other points of sale and points of use. As a result, skilled artisans have devoted considerable attention toward systems for holding product and feeding it forwardly to a point where it is highly visible and accessible to customers. Existing systems are efficient and usually incorporate interconnected tracks or trays that are capable of holding and feeding product forwardly. However, many stores regularly change their shelving configurations in order to add or delete products depending on demand or need. The tracks of most existing systems are designed and sized to accommodate a particular size of product. If the size of the product changes, existing tracks must be removed so they can be replaced with other appropriately sized tracks. Replacing tracks of existing systems is time consuming, labor intensive, difficult and, moreover, very frustrating.

Given these and other deficiencies in the art, there is a need for new and improved apparatus for holding and feeding product that is easy to make, easy to use, inexpensive, highly efficient and that incorporate tracks that are capable of being easily adjusted for accommodating product of varying size.

SUMMARY OF THE INVENTION

A product holding and feeding apparatus includes a) a tray having a front end, b) a sidewall clip, carried by a first extremity of a sidewall, attached to the front end of the tray, c) a paddle clip attached to the front end of the tray, d) an abutment clip, carried by an abutment, attached concurrently to the sidewall and paddle clips, e) a paddle mounted to the tray for reciprocal movement in opposition to the abutment, and f) a spring coupling the paddle clip to the paddle and biasing the paddle toward the abutment. The sidewall has a second extremity opposing the first extremity. Another sidewall clip, carried by the second extremity of the sidewall, is attached to the rear end of the tray. The tray has opposing sides and the front end has a length extending from one of the sides of the tray to the other of the sides of the tray. The abutment extends along substantially the entire length of the front end of the tray. The sidewall clip consists of a first body having a first inward engagement feature coupling a first outward complemental engagement feature carried by the tray, and an opposing second inward engagement feature coupling a second outward complemental engagement feature carried by the tray. The paddle clip consists of a second body having a third inward engagement feature coupling the first outward complemental engagement feature carried by the tray, and an opposing fourth inward engagement feature coupling the second outward complemental engagement feature carried by the tray. The first body supports an outward engagement feature, and the second body supports an outward engagement feature. The abutment clip consists of a body supporting a fifth inward complemental engagement feature concurrently coupling the outward engagement features of the first and second bodies, respectively, and a sixth inward complemental engagement feature coupling the second outward complemental engagement feature carried by the tray. Preferably, the tray has a plurality of reciprocal engagement points for the paddle between the sides of the tray, and the paddle is mounted to the tray at one of the plurality of engagement points for reciprocal movement in opposition to the abutment.

Another embodiment of a product holding and feeding apparatus includes a) a tray having a front end, b) a sidewall clip, attached to a sidewall, adapted to be attached to the front end of the tray, c) a paddle clip adapted to be attached to the front end of the tray, d) a paddle adapted to be attached to the tray for reciprocal movement in opposition to the front end of the tray, e) a spring coupling the paddle to the paddle clip, and f) an abutment clip, attached to an abutment, adapted to be attached concurrently to the sidewall and paddle clips. The sidewall has a second extremity opposing the first extremity. Another sidewall clip, carried by the second extremity of the sidewall, is adapted to be attached to the rear end of the tray. The tray has opposing sides and the front end has a length extending from one of the sides of the tray to the other of the sides of the tray. The abutment has a length that is substantially equal to the length of the front end of the tray. The sidewall clip consists of a first body having a first inward engagement feature adapted to be coupled to a first outward complemental engagement feature carried by the tray, and an opposing second inward engagement feature adapted to be coupled to a second outward complemental engagement feature carried by the tray. The paddle clip consists of a second body having a third inward engagement feature adapted to be coupled to the first outward complemental engagement feature carried by the tray, and an opposing fourth inward engagement feature adapted to be coupled to the second outward complemental engagement feature carried by the tray. The first body supports an outward engagement feature, and the second body supports an outward engagement feature. The abutment clip consists of a body supporting a fifth inward complemental engagement feature adapted to be concurrently coupled to the outward engagement features of the first and second bodies, respectively, and a sixth inward complemental engagement feature adapted to be coupled to the second outward complemental engagement feature carried by the tray.

Yet another embodiment of a product holding and feeding apparatus includes a) a tray having a front end, b) a sidewall clip, carried by a sidewall, attached to the front end of the tray, c) an abutment clip, carried by an abutment, attached to the sidewall clip, and d) a paddle mounted to the tray for reciprocal movement in opposition to the abutment, in which the paddle biased toward the abutment. A paddle clip is attached to the front end of the tray, and a spring couples the paddle clip to the paddle and biases the paddle toward the abutment. The sidewall has a second extremity opposing the first extremity. Another sidewall clip, carried by the second extremity of the sidewall, is attached to the rear end of the tray. The tray has opposing sides and the front end has a length extending from one of the sides of the tray to the other of the sides of the tray. The abutment extends along substantially the entire length of the front end of the tray. The sidewall clip consists of a first body having a first inward engagement feature coupling a first outward complemental engagement feature carried by the tray, and an opposing second inward engagement feature coupling a second outward complemental engagement feature carried by the tray. The paddle clip consists of a second body having a third inward engagement feature coupling the first outward complemental engagement feature carried by the tray, and an opposing fourth inward engagement feature coupling the second outward complemental engagement feature carried by the tray. The first body supports an outward engagement feature, and the second body supports an outward engagement feature. The abutment clip consists of a body supporting a fifth inward complemental engagement feature concurrently coupling the outward engagement features of the first and second bodies, respectively, and a sixth inward complemental engagement feature coupling the second outward complemental engagement feature carried by the tray. Preferably, the tray has a plurality of reciprocal engagement points for the paddle between the sides of the tray, and the paddle is mounted to the tray at one of the plurality of engagement points for reciprocal movement in opposition to the abutment.

Yet still another embodiment of a product holding and feeding apparatus includes a) a tray having a front end, b) a paddle clip adapted to be attached to the front end of the tray, c) a paddle adapted to be attached to the tray for reciprocal movement in opposition to the front end of the tray, d) a spring coupling the paddle to the paddle clip, and e) an abutment clip, attached to an abutment, adapted to be attached to the paddle clip. A sidewall clip, attached to a sidewall, is adapted to be attached to the front end of the tray. The abutment clip is adapted to be attached to the sidewall clip. The sidewall has a second extremity opposing the first extremity. Another sidewall clip, carried by the second extremity of the sidewall, is adapted to be attached to the rear end of the tray. The tray has opposing sides and the front end has a length extending from one of the sides of the tray to the other of the sides of the tray. The abutment has a length that is substantially equal to the length of the front end of the tray. The sidewall clip consists of a first body having a first inward engagement feature adapted to be coupled to a first outward complemental engagement feature carried by the tray, and an opposing second inward engagement feature adapted to be coupled to a second outward complemental engagement feature carried by the tray. The paddle clip consists of a second body having a third inward engagement feature adapted to be coupled to the first outward complemental engagement feature carried by the tray, and an opposing fourth inward engagement feature adapted to be coupled to the second outward complemental engagement feature carried by the tray. The first body supports an outward engagement feature, and the second body supports an outward engagement feature. The abutment clip consists of a body supporting a fifth inward complemental engagement feature adapted to be concurrently coupled to the outward engagement features of the first and second bodies, respectively, and a sixth inward complemental engagement feature adapted to be coupled to the second outward complemental engagement feature carried by the tray.

A further embodiment of a product holding and feeding apparatus includes a) a tray having a front end, b) a paddle clip attached to the front end of the tray, c) an abutment clip, carried by an abutment, attached to the paddle clip, d) a paddle mounted to the tray for reciprocal movement in opposition to the abutment, and e) a spring coupling the paddle clip to the paddle and biasing the paddle toward the abutment. A sidewall clip, carried by a first extremity of a sidewall, is attached to the front end of the tray. The abutment clip is attached to the sidewall clip. The sidewall has a second extremity opposing the first extremity. Another sidewall clip, carried by the second extremity of the sidewall, is attached to the rear end of the tray. The tray has opposing sides and the front end has a length extending from one of the sides of the tray to the other of the sides of the tray. The abutment extends along substantially the entire length of the front end of the tray. The sidewall clip consists of a first body having a first inward engagement feature coupling a first outward complemental engagement feature carried by the tray, and an opposing second inward engagement feature coupling a second outward complemental engagement feature carried by the tray. The paddle clip consists of a second body having a third inward engagement feature coupling the first outward complemental engagement feature carried by the tray, and an opposing fourth inward engagement feature coupling the second outward complemental engagement feature carried by the tray. The first body supports an outward engagement feature, and the second body supports an outward engagement feature. The abutment clip consists of a body supporting a fifth inward complemental engagement feature concurrently coupling the outward engagement features of the first and second bodies, respectively, and a sixth inward complemental engagement feature coupling the second outward complemental engagement feature carried by the tray. Preferably, the tray has a plurality of reciprocal engagement points for the paddle between the sides of the tray, and the paddle is mounted to the tray at one of the plurality of engagement points for reciprocal movement in opposition to the abutment.

Yet a further embodiment of a product holding and feeding apparatus includes a) a tray having a front end, b) a sidewall clip, attached to a sidewall, adapted to be attached to the front end of the tray, c) a paddle adapted to be attached to the tray for reciprocal movement in opposition to the front end of the tray and so as to be biased toward the front end of the tray, d) an abutment clip, attached to an abutment, adapted to be attached to the sidewall clip. A paddle clip is adapted to be attached to the front end of the tray. A spring couples the paddle to the paddle clip, and is operative for biasing the paddle toward the front end of the tray. The abutment clip is adapted to be attached concurrently to the sidewall and paddle clips. The sidewall has a second extremity opposing the first extremity. Another sidewall clip, carried by the second extremity of the sidewall, is adapted to be attached to the rear end of the tray. The tray has opposing sides and the front end has a length extending from one of the sides of the tray to the other of the sides of the tray. The abutment has a length that is substantially equal to the length of the front end of the tray. The sidewall clip consists of a first body having a first inward engagement feature adapted to be coupled to a first outward complemental engagement feature carried by the tray, and an opposing second inward engagement feature adapted to be coupled to a second outward complemental engagement feature carried by the tray. The paddle clip consists of a second body having a third inward engagement feature adapted to be coupled to the first outward complemental engagement feature carried by the tray, and an opposing fourth inward engagement feature adapted to be coupled to the second outward complemental engagement feature carried by the tray. The first body supports an outward engagement feature, and the second body supports an outward engagement feature. The abutment clip consists of a body supporting a fifth inward complemental engagement feature adapted to be concurrently coupled to the outward engagement features of the first and second bodies, respectively, and a sixth inward complemental engagement feature adapted to be coupled to the second outward complemental engagement feature carried by the tray.

Consistent with the foregoing summary of embodiments of the invention, and the ensuing disclosure, which are to be taken together, the invention also contemplates associated embodiments.

BRIEF DESCRIPTION OF THE DRAWINGS

Referring to the drawings.

DETAILED DESCRIPTION OF A PREFERRED EMBODIMENT

Figure 1:
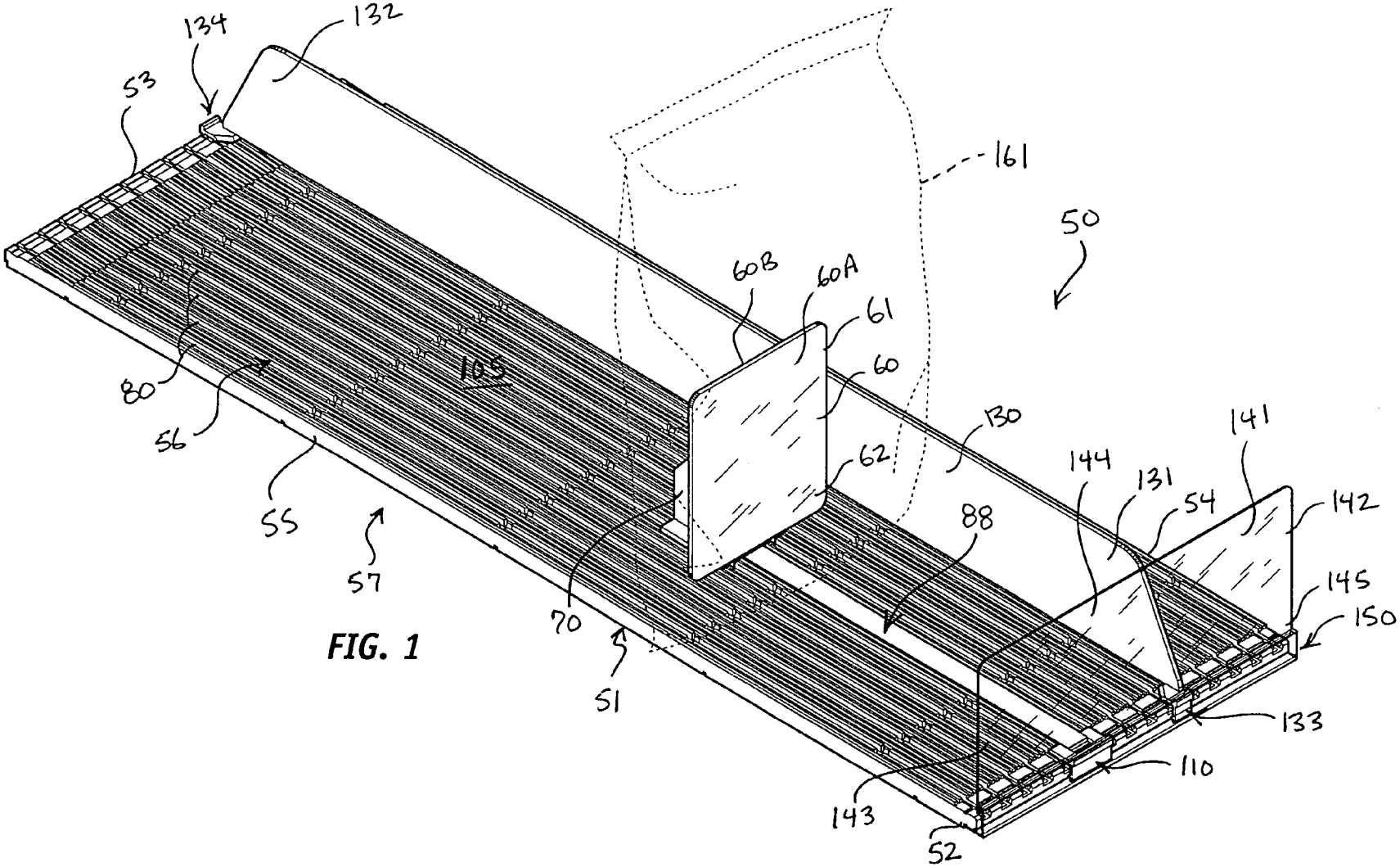
FIG. 1 is an isometric view of apparatus for holding and feeding product including a tray, a sidewall having a sidewall clip clipped to a front end of the tray, a paddle clip clipped to the front end of the tray, an abutment clip, carried by an abutment, clipped to the sidewall and paddle clips, a paddle mounted to the tray for reciprocal movement in opposition to the abutment, and a spring coupling the paddle clip to the paddle and biasing the paddle toward the abutment, in accordance with the principle of the invention.
Figure 5:
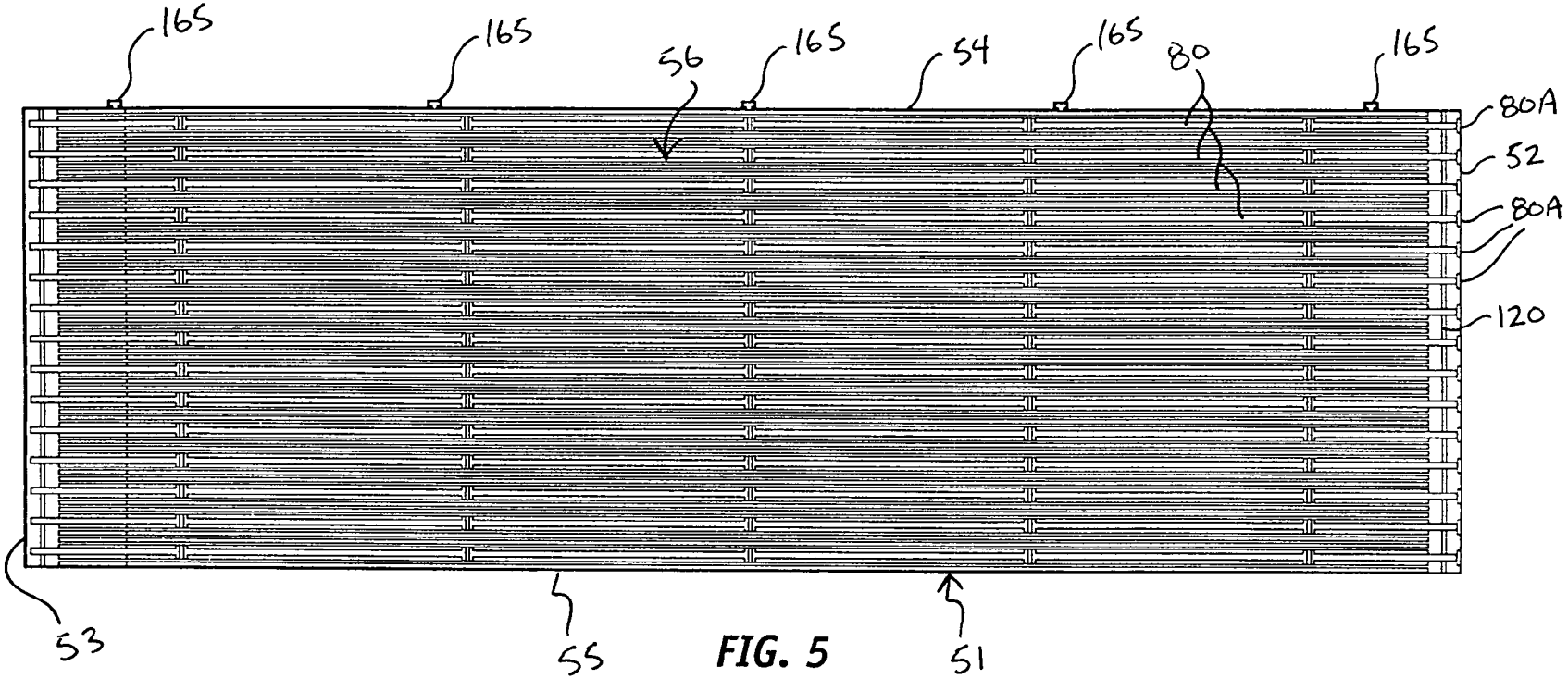
FIG. 5 is a top plan view of the tray of FIG. 1.
Figure 6:
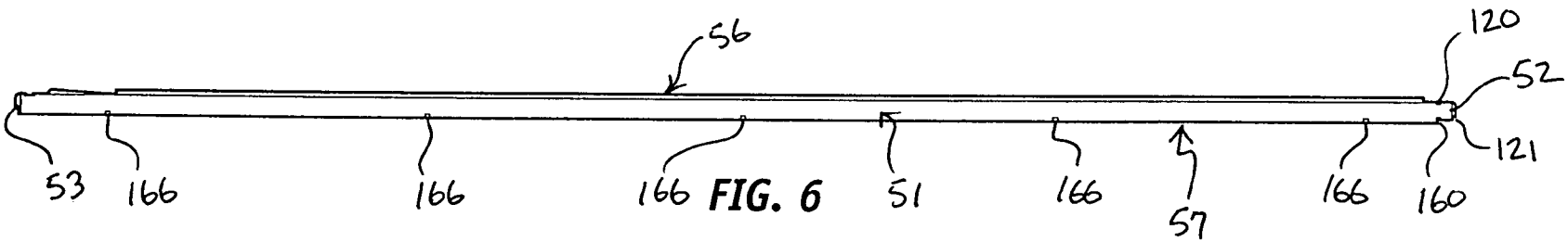
FIG. 6 is a right side elevational view of the tray of FIG. 1.
Figure 7:
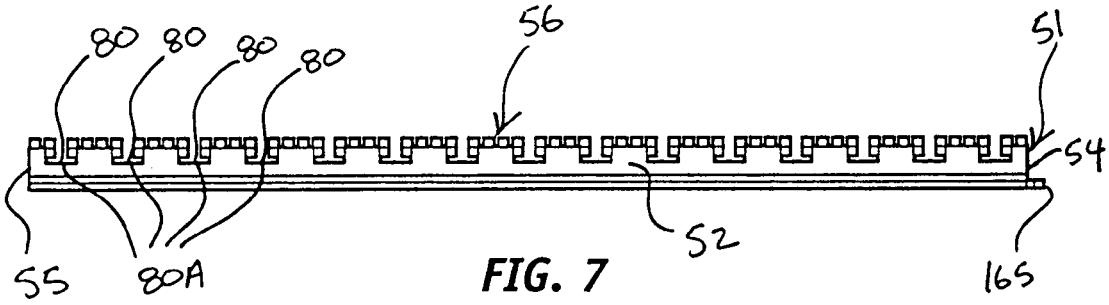
FIG. 7 is a front elevational view of the tray of FIG. 1.
Figure 8:
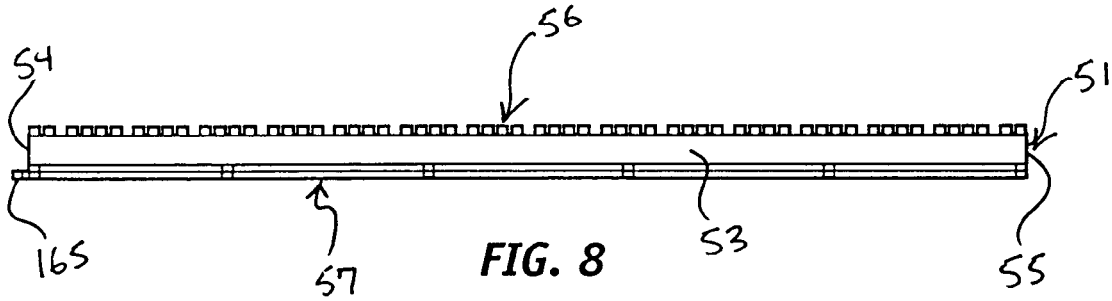
FIG. 8 is a rear elevational view of the tray of FIG. 1.
Figure 9:
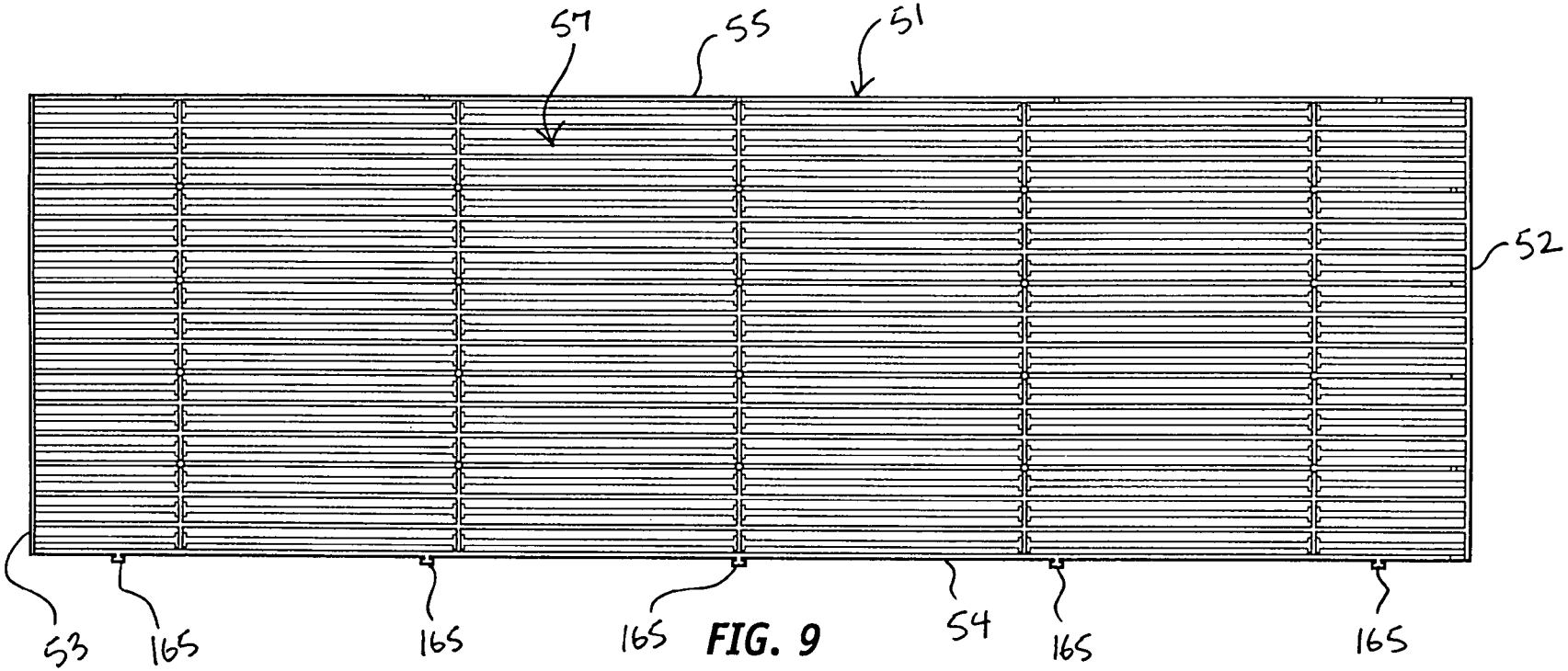
FIG. 9 is a bottom plan view of the tray of FIG. 1.
Figure 10:
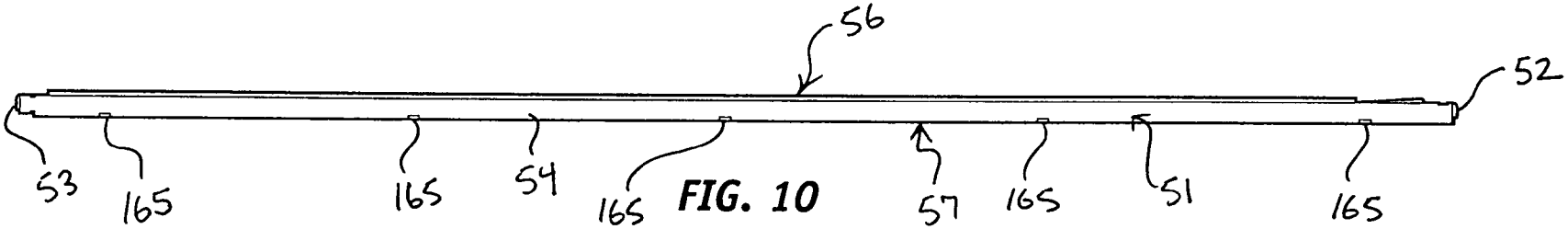
FIG. 10 is a left side elevational view of the tray of FIG. 1.

Turning to the drawings, in which like reference characters indicate corresponding elements throughout the several views, attention is first directed to FIG. 1 in which there is seen apparatus for holding and feeding product, embodying the principle of the instant invention, generally indicated by the reference character 50 including a tray 51 having a opposing ends 52,53, opposing sides 54,55, and opposing faces 56,57. Tray 51 has a predetermined length extending from end 52 to end 53, and a predetermined width extending from side 54 to side 55. The length and width of tray 51 may vary depending on the selected application. As a matter of disclosure, FIG. 5 is a top plan view of tray 51, FIG. 6 is a left side elevational view of tray 51, FIG. 7 is a front elevational view of tray 51, FIG. 8 is a rear elevational view of tray 51, FIG. 9 is a bottom plan view of tray 51 of FIG. 1, and FIG. 10 is a right side elevational view of tray 51. For the purpose or orientation only, it is to be understood ends 52 is considered a front or forward end of tray 51, end 53 is considered a rear or rearward end of tray 51, side 54 is considered a left side of tray 51, side 55 is considered a right side of tray, face 56 is considered an upper face of tray 51, and face 57 is considered a lower face of tray. Tray 51 is constructed of plastic, ABS, styrene, polypropylene or the like, and is integrally formed or assembled from two or more parts, with integral formation being preferred.

A paddle 60 is mounted to tray 51 between sides 54,55 for reciprocal movement in opposition to ends 52,53. Paddle 60, which can also be seen in FIG. 2, extends upwardly and away from face 56 and includes an upper end 61, a lower end 62, and opposing faces 60A,60B. A carriage 70 is attached to, and supports, paddle 60, and is considered part of paddle 60. Face 60A is directed toward end 52, and face 60B is directed toward end 53 (FIG. 1). Face 60A is a product engaging face. Carriage 70 extends rearwardly of face 60B in this embodiment. However, carriage 70 can face forwardly of face 60A if desired or both rearwardly and forwardly of paddle 60 as well.

Figure 4:
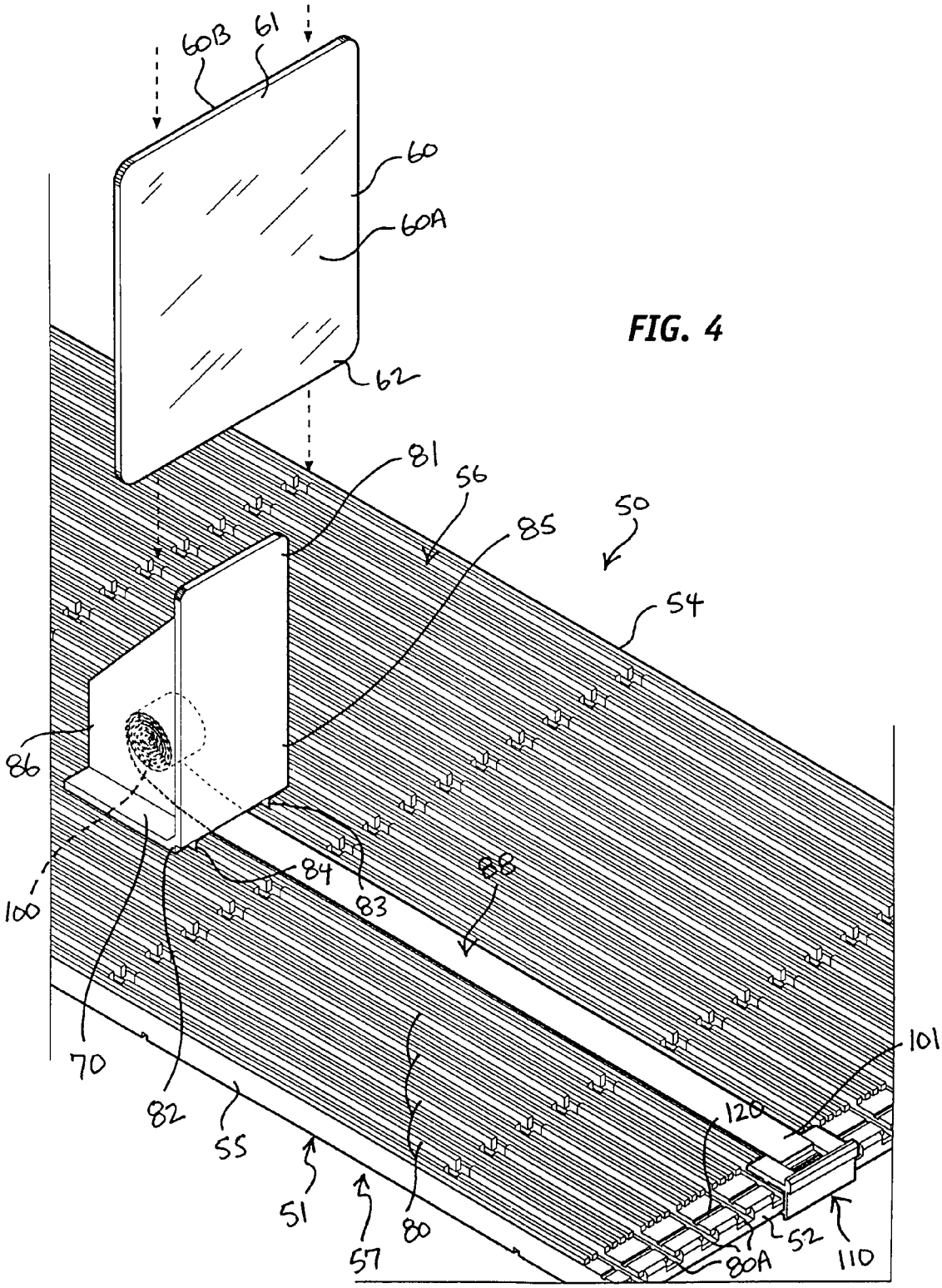
FIG. 4 is fragmented isometric view of the apparatus of FIG. 1 illustrating the paddle as it would appear detached from a carriage mounted to the tray for reciprocal movement and to the spring.
Figure 17:
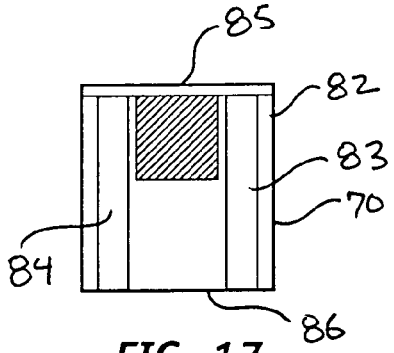
FIG. 17 is a bottom plan view of the carriage of FIG.4.
Figure 22:
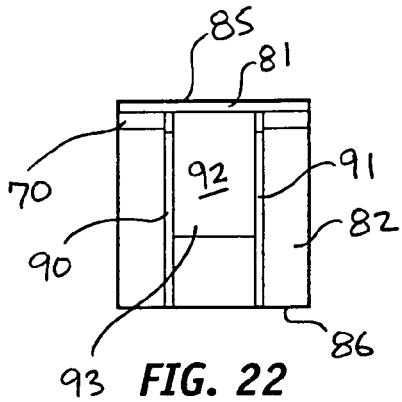
FIG. 22 is a top plan view of the carriage of FIG. 4.
Figure 18:
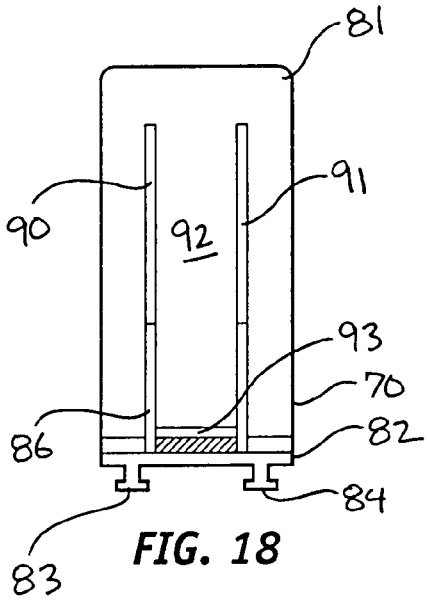
FIG. 18 is a rear elevational view of the carriage of FIG. 4.
Figure 21:
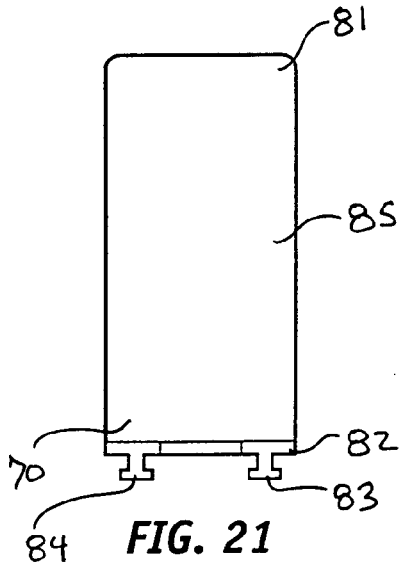
FIG. 21 is a front elevational view of the carriage of FIG. 4.
Figure 19:
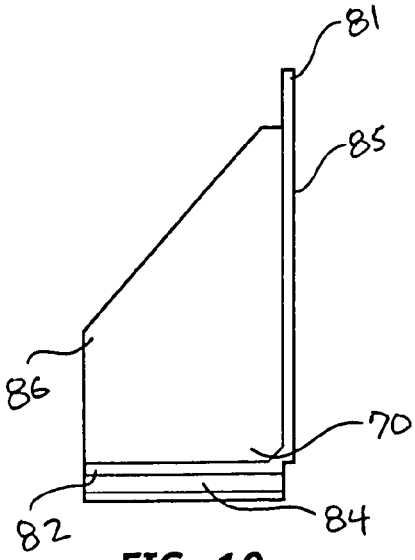
FIG. 19 is a right side elevational view of the carriage of FIG. 4.
Figure 20:
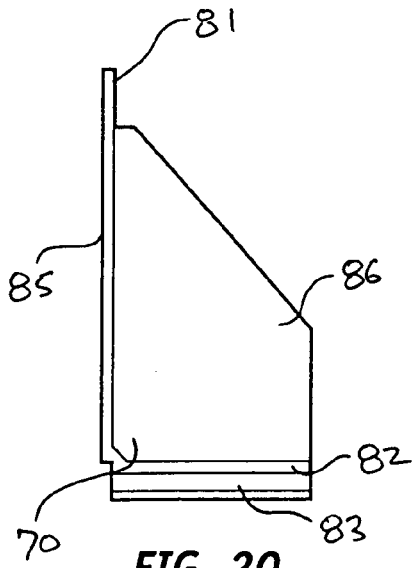
FIG. 20 is a left side elevational view of the carriage of FIG. 4.

Paddle 60, and carriage 70, are each constructed of plastic, ABS, styrene, polypropylene or the like and other materials can be used if desired. Paddle 60 and carriage 70 can be integrally formed, or fashioned as an assembly of two or more parts. In this regard, it is to be understood that paddle 60 and carriage 70 can be fashioned as separate parts, and then paddle 60 subsequently engaged to carriage 70, such as with one or more mechanical fasteners, a tongue-and-groove assembly, adhesive, etc., in which carriage 70 is considered part of, or otherwise an extension of, paddle 60 when attached thereto, and vice-versa. FIG. 4 shows paddle 60 as it would appear detached from carriage 70 for illustrative purposes. As a matter of disclosure, FIG. 17 is a bottom plan view of carriage 70, FIG. 18 is a rear elevational view of carriage 70, FIG. 19 is a right side elevational view of carriage 70, FIG. 20 is a left side elevational view of carriage 70, FIG. 21 is a front elevational view of carriage 70, and FIG. 22 is a top plan view of carriage 70.

Regarding FIG. 1, tray 51 supports spaced-apart parallel grooves 80, which are disposed at face 56, extend longitudinally of tray 51 from end 52 to end 53, and are disposed at equally spaced-apart intervals from side 54 to side 55. Preferably, grooves 80 are formed into tray 51. Looking to FIGS. 3, 18, and 21, carriage 70 has an upper extremity 81, a lower extremity 82, opposing parallel tongues 83,84, which are disposed at lower extremity 82 and project downwardly therefrom, a front end 85 and a rear end 86. Tongues 83,84 are each adapted to be slidably received be each of grooves 80. Grooves 80 each have a shape that complements each of tongues 83,84, in which each of tongues 83,84 is capable of being received by each of grooves 80 so as to reciprocate therethrough. In this particular embodiment, grooves 80 are each generally T-shaped, and tongues 83,84 each having a complementing T-shape. It is to be understood, that other complementing shapes of grooves and complementing tongues may be used for grooves 80 and tongues 83,84 for facilitating a sliding, reciprocal attachment of carriage 70 to tray 51.

Figure 2:
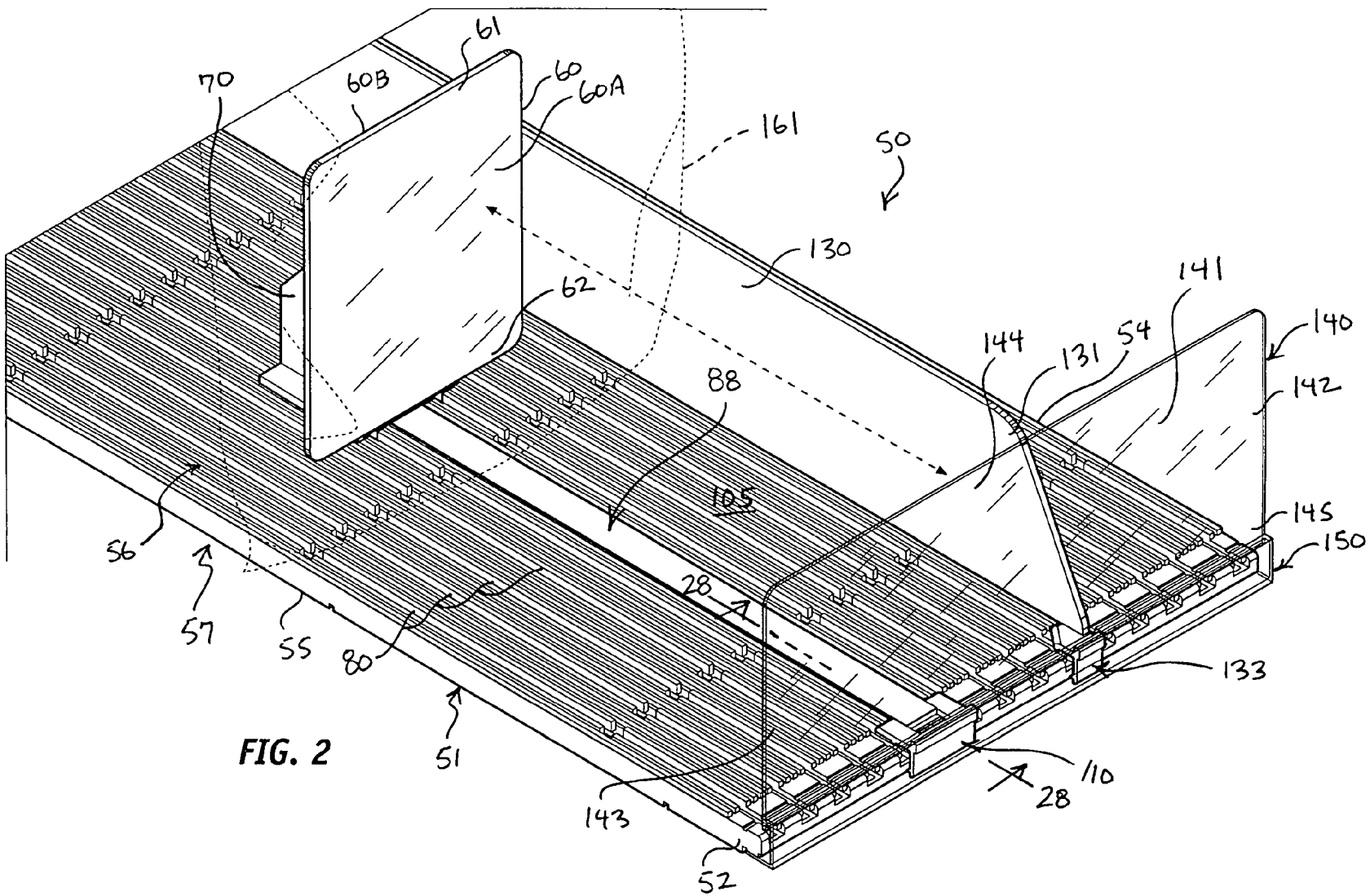
FIG. 2 is an enlarged fragmented view of the apparatus of FIG. 1.
Figure 3:
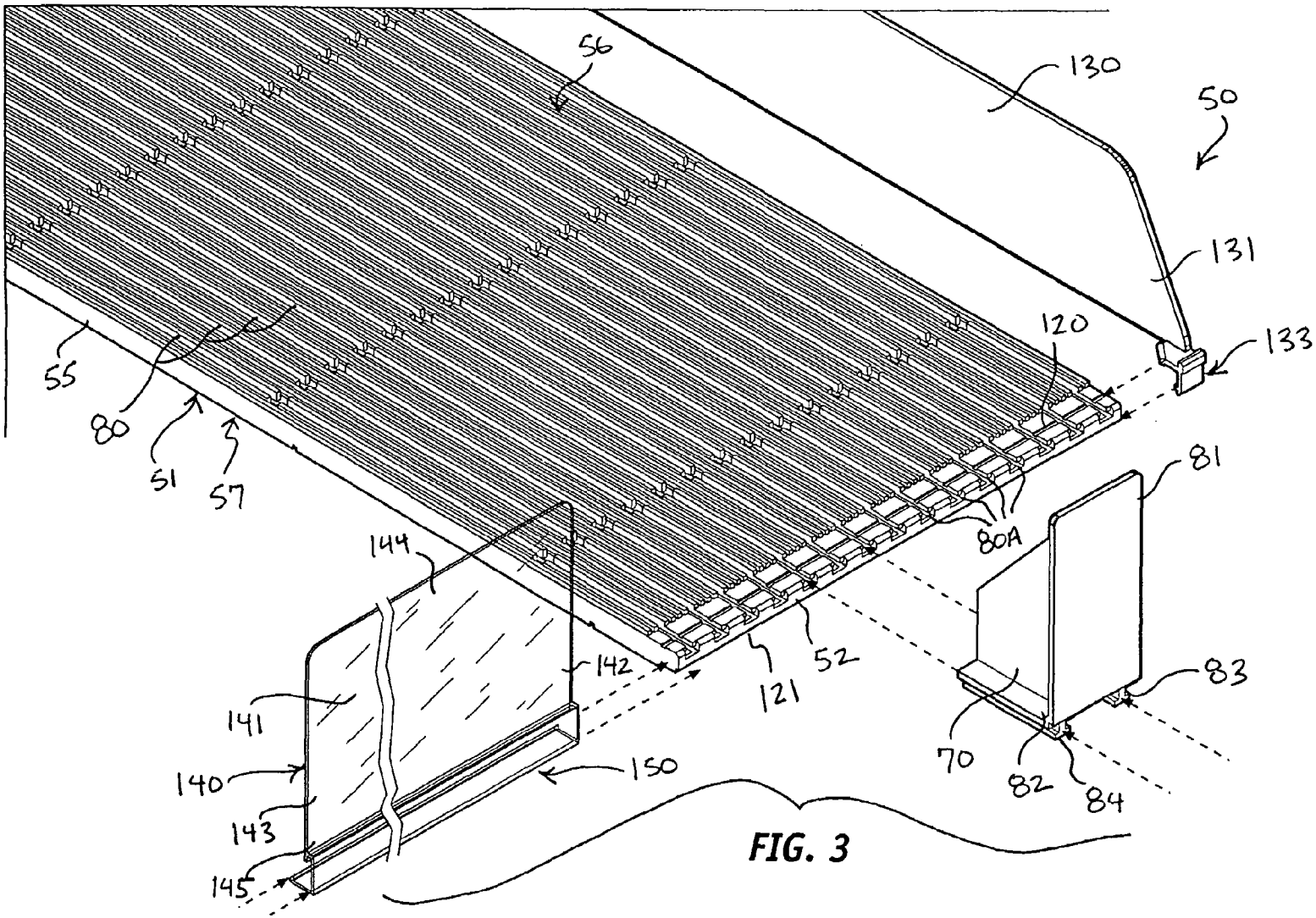
FIG. 3 is an exploded partially fragmented isometric view of the apparatus of FIG. 1.

As seen in FIGS. 3 and 4, grooves 80 each have an open end designated at 80A at end 52. To install carriage 70, it is taken up, such as by hand, and held upright with lower extremity 82 disposed downward and upper extremity 81 disposed upward. Carriage 70 is maneuvered so as to confront end 52 of tray 51, and rear end 86 of carriage 70 is directed toward end 52 of tray 51 so as to direct the rearward ends of tongues 83,84 toward an opposing pair of grooves 80. In accordance with a preferred embodiment, it is to be noted that the on-center distance separating tongues 83,84 is equal 52 to the on-center distance between three grooves 80. After aligning tongues 83,84 with a desired pair of grooves 80, tongues are presented through open ends 80A of the respective grooves 80, and then slid therethrough thus to be attached to tray 50 for reciprocal movement through the grooves between, and in opposition to, ends 52,53. Reversing the foregoing operation detaches carriage 70 from tray 70. As seen in FIGS. 1, 2, and 3, carriage 70 is shown as it would appear attached to tray for reciprocal movement between sides 54,55.

Tongues 83,84 and grooves 80 represent complementing engagement features. In the immediate embodiment as best seen in FIG. 3, tray 51 is formed with fifteen grooves 80, and less or more may be provided, if desired. Corresponding pairs of grooves 80 define engagement points for reciprocal movement for tongues 83,84 of carriage 70, permitting carriage 70 to be mounted to tray for reciprocal movement at selected engagement points for reciprocal movement between sides 54,55. Because there are fifteen grooves 80 in tray 51 and two corresponding tongues 83,84 carried by carriage 70, there are fourteen engagement points for reciprocal movement for carriage 70 to tray 51 between sides 54,55.

If desired, tongues 83,84 and grooves 80 can be arranged such that the on-center distance separating tongues 83,84 is equal to the on-center distance between each pair of grooves 80 separated by no other groove, or each pair of grooves 80 separated by more than one groove, such as two more. Although carriage 70 incorporates two tongues, namely, tongues 83,84, it can be fashioned with less or more, if desired.

Although grooves are carried by tray 51 and detachably engagable tongues are carried by carriage 70, this arrangement can be reversed, if desired, in which case tray 51 would be fashioned with tongues and carriage 70 would be fashioned with detachably engagable grooves. Consistent with this disclosure, those skilled in the art will readily appreciate that any suitable attachment between paddle 60 and tray 51 capable of permitting paddle 60 to be mounted to tray 51 for reciprocal movement in opposition to ends 52,53 at spaced intervals or engagement points between sides 54,55 can be used without departing from the invention.

As seen in FIGS. 1 and 2, paddle 60, and carriage 70, project upward from upper face 56, and are located at a space 105 above upper face 56. Paddle 60 is biased toward end 52 of tray 51. A force applied to paddle 60 biasing it toward end 53 is provided with a spring 88. Referring to FIGS. 18 and 22, carriage 70 has opposing, spaced-apart rearwardly projecting sidewalls 90,91 that are separated by, and generally define, a pocket 92. Looking to FIG. 27, carriage 70 supports an attached abutment 93, located toward lower extremity 82, which projects rearwardly from front end 85 to rear end 86. Spring 88 is a coil 100 of flat spring material, such as spring steel, having shape memory. Coil 100 is disposed at pocket 92 and contained therein between sidewalls 90,91, abuts up against abutment 93, and has an end 101 that extends outwardly through an opening 102 formed through carriage 70 at lower extremity 82. End 101 is coupled to a clip 110 that is adapted and arranged to clip to end 52 of tray 51, as seen in FIGS. 1, 2, and 4. Coil 100 is shown in dotted outline in FIG. 4. Because coil 100 is constructed of a spring material having shape memory, it wants to maintain its coiled shape. With clip 120 attached to end 52 as seen in FIGS. 1, 2, and 4, spring 88 functions to bias carriage 70, and thus paddle 60, toward end 52.

Figure 27:
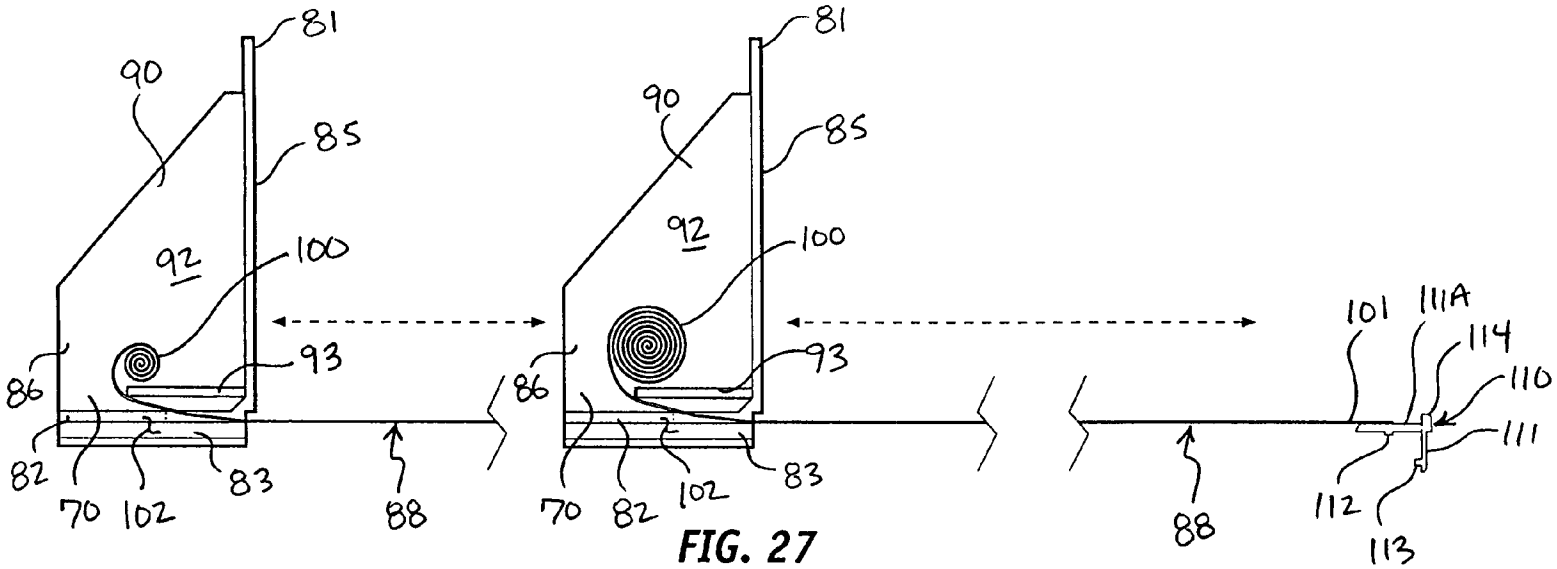
FIG. 27 is a schematic representation of the carriage of FIG. 4 and its interrelationship with the paddle clip and the spring, with portions of the carriage sectioned away for the purpose of illustration.
Figure 28:
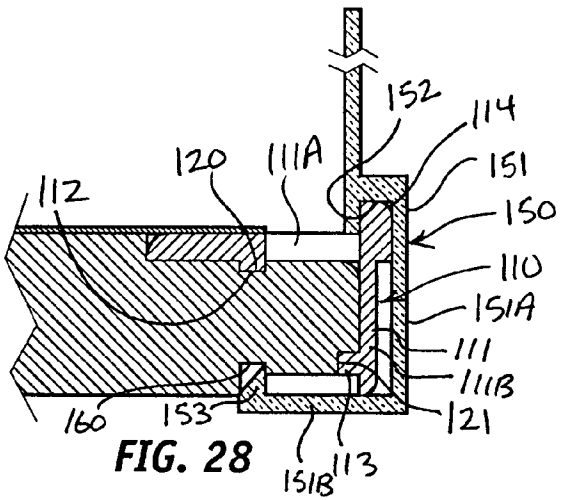
FIG. 28 is a sectional view taken along line 28-28 of FIG. 2.

Referring to FIGS. 27 and 28, clip 110 consists of a body 111 that supports opposing, inwardly directed tongues 112, 113, and an outwardly and upwardly projecting tongue 114 therebetween. Body 111 includes a generally horizontal body portion or finger 111A and a generally vertical body portion or finger 111B attached to, and extending downwardly from, portion 111A. Tongue 112 extends downwardly/inwardly from portion 111A, and tongue 113 extends rearward/inwardly from portion 111B. Because tongues 112,113 are directed inwardly, they are considered inwardly directed features. Tongue 114 is disposed generally at the point where portions 111A,111B intersect.

With continuing reference to FIG. 28, and additional reference to FIG. 3, an elongate, transverse groove 120 is formed into tray 51 at upper face 56 proximate, and somewhat inboard of, end 52, and an opposing elongate, transverse groove 121 is formed into end 52 of tray 51 at lower face 57. Grooves 120,121 are not only transverse relative to tray 51, but also extend along the entire width of end 52 of tray 51 from side 54 to side 55. Grooves 120,121 are directed outwardly, and are therefore considered outwardly directed features. Clip 110 is adapted to be clipped to end 52 of tray 51, in which grooves 120,121 are sized and positioned to receive therein tongues 112,113 as maintained by portions 111A, 111B, respectively, so as to provide a clipping engagement of clip 110 to end 52 of tray 52 as seen in FIG. 28, and also in FIGS. 104. Properly installed, clip 110 overlies end 52, in which portion 111A rests atop tray 51 at end 52, portion 111B is disposed outboard of end 52, and portions 111A,111B maintain the engagement of tongues 112,113 to grooves 120, 121, respectively, providing a clipping or gripping engagement.

Figure 25:
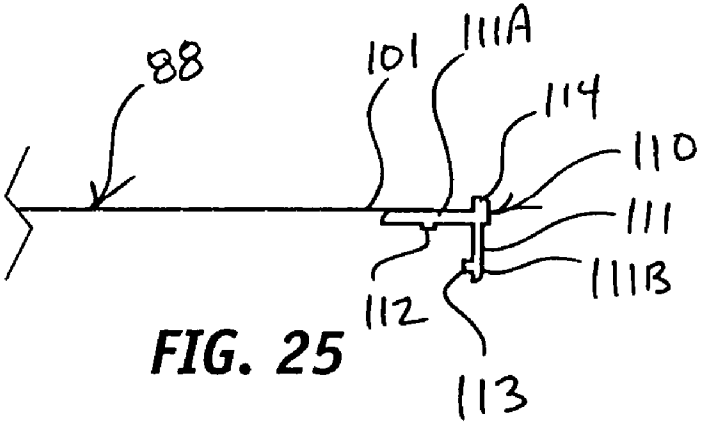
FIG. 25 is a right side elevational view of the paddle clip of FIG. 1, the right side elevational view being a substantial mirror image thereof, and a portion of the spring.
Figure 26:
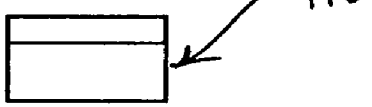
FIG. 26 is a front elevational view of the paddle clip of FIG. 1.
Figure 23:
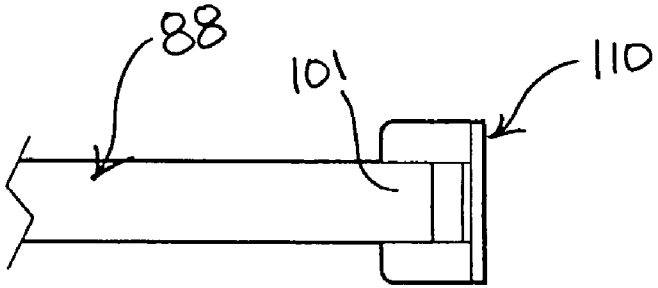
FIG. 23 is a top plan view of the paddle clip of FIG. 1 and a portion of the spring.
Figure 24:
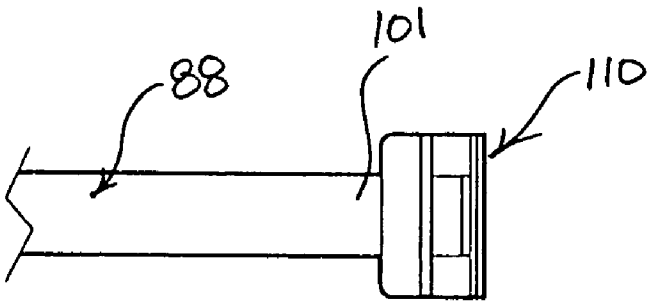
FIG. 24 is a bottom plan view of the paddle clip of FIG. 1 and a portion of the spring.

Clip 110 can be snapped into place, or tongues 112,113 slid into and through grooves 120,121, respectively, from side 54 or side 55. Because grooves 120,121 extend along the entire width of end 52 from side 54 to side 55, clip 110 can be attached to end 52 at any desired location from side 54 to side 55 so as to correspond to any location of paddle 60. Clip 110 is constructed of plastic, ABS, styrene, polypropylene or the like and other materials can be used if desired. Clip 110 can be integrally formed, or fashioned as an assembly of two or more parts. As a matter of disclosure, FIG. 23 is a top plan view of clip 110 and a portion of spring 88 including end 101, FIG. 24 is a bottom plan view of clip 110 and a portion of spring 88 including end 101, FIG. 25 is a right side elevational view of clip 110 and a portion of spring 88 including end 101, and FIG. 26 is a front elevational view of clip 110.

Tongues 112,113 and grooves 120,121 represent complementing engagement features. Although tongues 112,113 are carried by clip 110 and detachably engagable grooves 120, 121 are carried by tray 51, this arrangement can be reversed, if desired, in which case the described engagement of clip 110 to tray 51 would be made with tongues carried by tray 51 and corresponding grooves carried by clip 110.

Sidewalls are to be attached to tray 51 on either side of paddle 60, and carriage 70, so as to define space 105 therebetween at which paddle 60, and carriage 70, are located. FIGS. 1 and 2 illustrate only one sidewall denoted by the reference character 130 proximate side 54 of tray 51 as a matter of illustration, with the understanding that an identical sidewall can be attached to tray 51 on the other side of paddle 60, and carriage 70, proximate side 55.

Figures 11, 12, 13, 14, 15, 16:
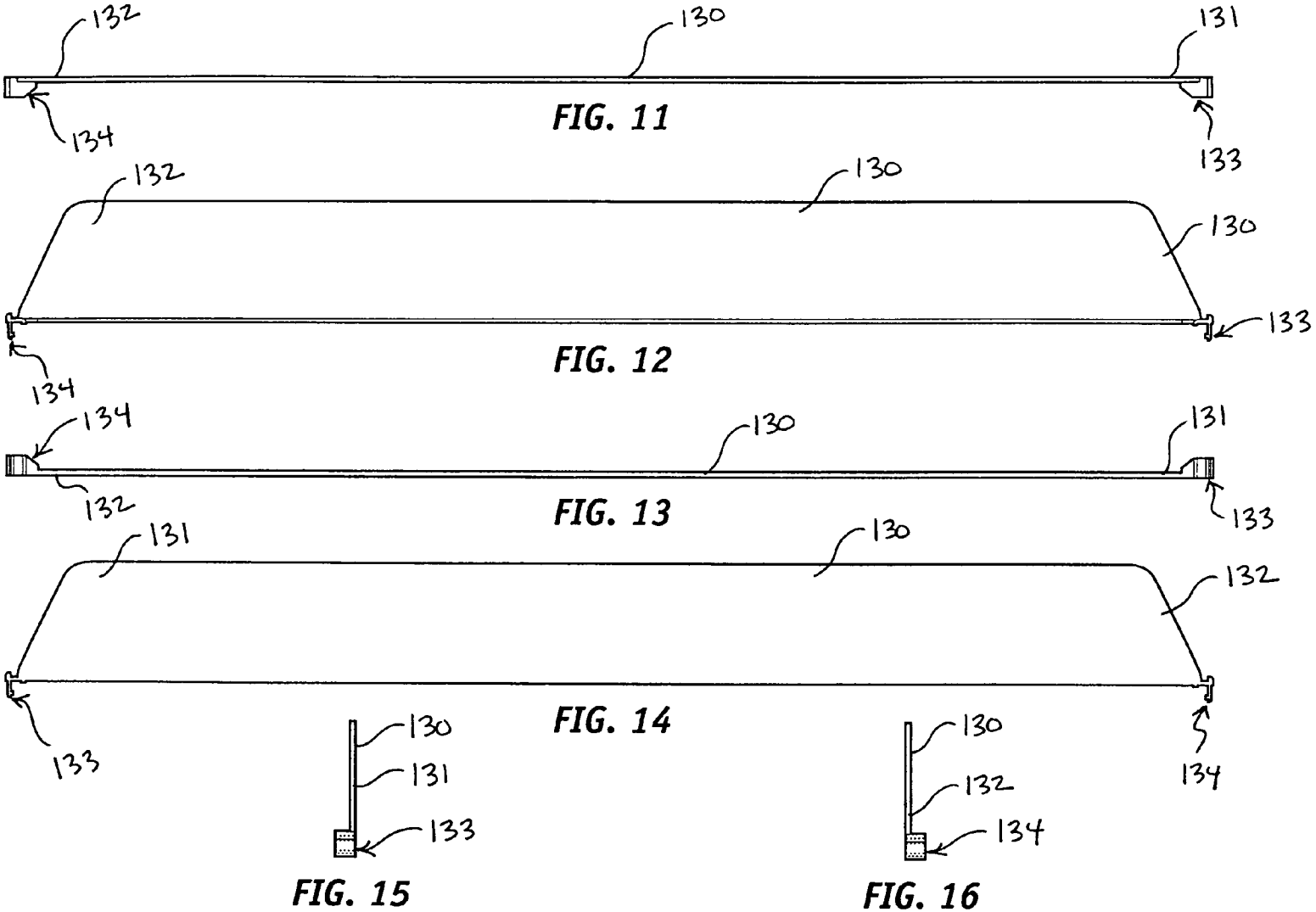
FIG. 11 is a top plan view of the sidewall of FIG. 1.
FIG. 12 is a right side elevational view of the sidewall of FIG. 1.
FIG. 13 is a bottom plan view of the sidewall of FIG. 1.
FIG. 14 is a left side elevational view of the sidewall of FIG. 1.
FIG. 15 is a front elevational view of the sidewall of FIG. 1.
FIG. 16 is a rear elevational view of the sidewall of FIG. 1.

Referring to FIG. 2, sidewall 130 will now be described, with the understanding that the ensuing discussion applies to all sidewalls used with the invention. Sidewall 130 is generally flat and straight, extends upwardly from upper face 56, and has opposing extremities 131,132 with clips 133,134 attached thereto as illustrated, in which clip 133 is clipped to end 52 of tray 51 and clip 134 is clipped to end 53 of tray 51. Sidewall 130 extends longitudinally of tray along substantially the entire length thereof from end 52 to end 53. Sidewalls 130 is constructed of plastic, ABS, styrene, polypropylene or the like, and is integrally formed or assembled from two or more parts with integral formation being preferred. Clips 133,134 are each identical to clip 110, and couple to ends 52,53, respectively, in the same manner as clip 110. Accordingly, it is to be understood that the discussion of clip 110 applies to each of clips 133,134, including their corresponding attachments to ends 52,53, respectively. As a matter of disclosure, FIG. 11 is a top plan view of sidewall 130, FIG. 12 is a right side elevational view of sidewall 130, FIG. 13 is a bottom plan view of sidewall 130, FIG. 14 is a left side elevational view of sidewall 130 of FIG. 1, FIG. 15 is a front elevational view of sidewall 130, and FIG. 16 is a rear elevational view of sidewall 130.

Referring to FIG. 1, an abutment 140 is provided, which is positioned adjacent to end 52 of tray 51. Abutment 140 is constructed of plastic, ABS, styrene, polypropylene or the like and is integrally formed or assembled from two or more parts with integral formation being preferred. In the immediate embodiment, the entirety of abutment 140 is fashioned of clear plastic material as a matter of example, with the understanding the abutment 140 can be fashioned only partially of transparent material or fashioned entirely of non-transparent material.

Abutment 140 consists of an elongate shield 141 having opposing sides 142,143 and opposing upper and lower ends 144,145, and a length from side 142 to side 143. Consistent with the teachings of this disclosure, and the functional relationship between the various components of the invention herein specifically described, the length of shield 141 can be substantially equal to the length of end 52 of tray from side 54 to side 55, greater than the length of end 52 of tray from side 54 to side 55, or less that the length of end 52 of tray from side 54 to side 55. An elongate clip 150 is attached to lower end 145 of shield 141, which extends along substantially the entire length of shield 141 from side 142 to side 143. Clip 150 clips to, and concurrently engages, clips 110,133, which secures abutment 140 in place to tray 51, in which shield 141 projects upwardly from end 52 of tray 51 and opposes or otherwise confronts face 60A of paddle 27.

Referring to FIG. 28, clip 150 consists of a body 151 that supports an inwardly directed groove 152 and an opposing inwardly directed tongue 153. Body 151 includes a generally vertical body portion or finger 151A, to which shield 141 is attached, and a generally horizontal vertical body portion or finger 151B attached to, and extending rearwardly from, portion 151A. Groove 152 is carried by portion 151A, and extends downwardly/inwardly from portion 151A. Tongue 153 is carried by portion 151B and extends upwardly/inwardly from portion 111B. Because groove 152 and tongue 153 project inwardly, they are considered inwardly directed features.

An elongate, transverse groove 160 is formed into tray 51 at lower face 57 inboard of end 52 and groove 121. Groove 160 is not only transverse relative to tray 51, but also extends along the entire width of end 52 of tray 51 from side 54 to side 55. Groove 160 is directed outwardly, and is therefore considered an outwardly directed feature. Clip 150 is adapted to be clipped concurrently to clips 110,133, in which groove 152 concurrently receives therein tongues 114 of clips 110,133, and groove 160 is sized and positioned to receive therein tongue 153, thus providing a clipping engagement of clip 150 to clips 110,133 and to end 52 of tray 51, and thus also tying or otherwise coupling clip 110 to clips 110,133, as seen in FIGS. 1 and 2. Properly installed, clip 150 overlies end 52 and clips 110,133, in which portion 151A is attached to and overlies and is disposed outboard of portion 111B, and portion 151B projects rearwardly and is disposed beneath end 52. It is to be understood that clip 150 can be snapped into place, or groove 152 and tongue 153 slid into engagement with tongues 114 of clips 110,133 and groove 160, respectively, such as from side 54 or side 55.

Tongues 114 of clips 110,133, and groove 152 represent complementing engagement features, and this arrangement can be reversed, if desired. Tongue 153 and groove 160 also represent complementing engagement features, and this arrangement can also be reversed, if desired.

In accordance with the described structure of apparatus 50, it is capable of holding product to be fed toward shield 141 and feeding the product to shield 141 as it is removed therefrom by customers. In operation, paddle 60 is forcibly moved away from shield 141 or otherwise toward end 53 of tray 51 and a row of product is positioned atop upper face 56 longitudinally of tray 51 between face 60A of paddle 60 and shield 141, and the sidewalls attached to tray 51 as previously discussed, in which sidewall 130 represents just such a sidewall. When paddle 60 is released from its forced manipulation, spring 88 biases it against the row of product, capturing it by and between face 60A of paddle 60 and shield 141. Product can also be pushed and loaded upon tray 51 between face 60A of paddle 60 and shield 141, causing paddle 60 to be forced rearwardly away from shield 141 as the product is so loaded. Face 60A engages the rear end of the row of product and is considered a product engaging face, and shield 141 engages the forward end of the row of product and prevents product from being pushed outwardly from end 52. The row of product is typically bags, boxes or other form of packaged product. Unpackaged products can also be loaded onto track tray 51 as well. Track 12 is normally positioned on a shelf or otherwise located at a point of sale or interest and end 52 presents the product to customers. Tray 51 can simply rest upon a display shelf or perhaps be attached with screws, adhesive, hook and loop attachment structure provided under the exemplary VELCRO trademark, etc. As consumers encounter the product loaded in tray 51 and remove it over shield 141, paddle 60 pushes the row forwardly so as to feed and present the product against shield 141. When the supply of product becomes diminished, tray 51 is simply reloaded. As a matter of illustration, FIGS. 1 and 2 shows a bag 161 located between face 60A of paddle 60 and shield 141. Shield 41 can be transparent for permitting substantially unobstructed view of the product carried by tray 51. Shield 141 can also be furnished with indicia, whether advertising indicia, indicia identifying the product held by tray 51.

Trays constructed and arranged in accordance with the principle of the invention can be placed side by side, if desired, and, if desired, coupled together with a suitable engagement structure. As a matter of example of this aspect, FIGS. 5, 9, and 10 show spaced-apart tongues carried by, and projecting outwardly from, side 54 of tray 51, and FIGS. 6 show corresponding spaced apart slots/grooves 166 formed into side 55 of tray 51, in which tongues 165 of one tray fashioned in accordance with the principle of the invention are to be removable attached to slots/grooves 166 of another tray constructed in accordance with the principle of the invention, thus facilitating a side-by-side engagement of adjacent trays. It is to be understood that other ways of mechanically fasting one tray to another tray may be used without departing from the invention. Also, if desired a single abutment 140 may be used for a plurality of trays, coupling the clips 110,113 of each tray.

A product holding and feeding apparatus is disclosed. Paddle 60 can be easily attached to tray 51 at spaced-apart locations from side 54 to side 55, clip 110 can be attached at any location along end 52 of tray 51 between sides 54,55 for corresponding to the location of paddle 60, and clips 133,134 of sidewall 130, and other like sidewalls for that matter, can be attached at any locations along front and rear ends 52,54, respectively, of tray between sides 54,55 for accommodating differently-sized products at space 105. Apparatus 50 is easily assembled and disassembled by way of clips 110,133,150, in which clips 110,133 are easily and efficiently engagable to end 52 of tray 51, and clip 150 is easily and efficiently engagable to clips 110,133 so as to tie them together and secure abutment 140 to end 52 of tray 51.

The present invention is described above with reference to a preferred embodiment. However, those skilled in the art will recognize that changes and modifications may be made to the described embodiments without departing from the nature and scope of the present invention. Various changes and modifications to the embodiments herein chosen for purposes of illustration will readily occur to those skilled in the art and engagement pairs can be reversed. The various tongue and groove engagement pairs can each single features, or each defined by broken or separate features that are capable of cooperating as one of a given engagement element of an engagement pair. To the extent that such modifications and variations do not depart from the spirit of the invention, they are intended to be included within the scope thereof, which is assessed only by a proper interpretation of the following claims.

Having fully described the invention in such clear and concise terms as to enable those skilled in the art to understand and practice the same, the invention claimed is:

1. Apparatus comprising:

a tray having a front edge and opposing sides;

a sidewall clip, carried by a first extremity of a sidewall, attached to the front edge of the tray;

a paddle clip attached to the front edge of the tray;

an abutment clip, carried by an abutment, attached concurrently to the sidewall and paddle clips securing the abutment to the tray;

a paddle;

the tray having a plurality of reciprocal engagement points for the paddle between the sides of the tray;

the paddle mounted to the tray at one of the plurality of engagement points for reciprocal movement in opposition to the abutment; and a spring coupling the paddle clip to the paddle and biasing the paddle toward the abutment.

2. Apparatus of claim 1, further comprising:

the sidewall having a second extremity opposing the first extremity; and another sidewall clip, carried by the second extremity of the sidewall, attached to a rear end of the tray.

3. Apparatus of claim 1, further comprising:

the tray having opposing sides and the front edge having a length extending from one of the sides of the tray to the other of the sides of the tray; and the abutment extending along substantially the entire length of the front edge of the tray.

4. Apparatus of claim 1, the sidewall clip comprising a first body having a first inward engagement feature coupling a first outward complemental engagement feature carried by the tray, and an opposing second inward engagement feature coupling a second outward complemental engagement feature carried by the tray.

5. Apparatus of claim 4, the paddle clip comprising a second body having a third inward engagement feature coupling the first outward complemental engagement feature carried by the tray, and an opposing fourth inward engagement feature coupling the second outward complemental engagement feature carried by the tray.

6. Apparatus of claim 5, further comprising:

the first body supporting an outward engagement feature;

the second body supporting an outward engagement feature; and the abutment clip comprising a body supporting a fifth inward complemental engagement feature concurrently coupling the outward engagement features of the first and second bodies, respectively, and a sixth inward complemental engagement feature coupling the second outward complemental engagement feature carried by the tray.

7. Apparatus comprising:

a tray having a front edge and opposing sides;

a sidewall clip, carried by a sidewall, attached to the front edge of the tray;

an abutment clip, carried by an abutment, attached to the sidewall clip by clipping the abutment clip directly onto the sidewall clip securing the abutment to the tray;

a paddle;

the tray having a plurality of reciprocal engagement points for the paddle between the sides of the tray; and the paddle mounted to the tray at one of the plurality of engagement points for reciprocal movement in opposition to the abutment, the paddle biased toward the abutment.

8. Apparatus of claim 7, further comprising:

a paddle clip attached to the front edge of the tray; and a spring coupling the paddle clip to the paddle and biasing the paddle toward the abutment.

9. Apparatus of claim 8, the sidewall clip comprising a first body having a first inward engagement feature coupling a first outward complemental engagement feature carried by the tray, and an opposing second inward engagement feature coupling a second outward complemental engagement feature carried by the tray.

10. Apparatus of claim 9, the paddle clip comprising a second body having a third inward engagement feature coupling the first outward complemental engagement feature carried by the tray, and an opposing fourth inward engagement feature coupling the second outward complemental engagement feature carried by the tray.

11. Apparatus of claim 10, further comprising:

the first body supporting an outward engagement feature;

the second body supporting an outward engagement feature; and the abutment clip comprising a body supporting a fifth inward complemental engagement feature concurrently coupling the outward engagement features of the first and second bodies, respectively, and a sixth inward complemental engagement feature coupling the second outward complemental engagement feature carried by the tray.

12. Apparatus of claim 7, further comprising:

the sidewall having a second extremity opposing the first extremity; and another sidewall clip, carried by the second extremity of the sidewall, attached to a rear end of the tray.

13. Apparatus of claim 7, further comprising:

the tray having opposing sides and the front edge having a length extending from one of the sides of the tray to the other of the sides of the tray; and the abutment extending along substantially the entire length of the front edge of the tray.

14. Apparatus comprising:

a tray having a front edge and opposing sides;

a paddle clip attached to the front edge of the tray;

an abutment clip, carried by an abutment, attached to the paddle clip by clipping the abutment clip directly onto the paddle clip securing the abutment to the tray;

a paddle;

the tray having a plurality of reciprocal engagement points for the paddle between the sides of the tray;

the paddle mounted to the tray at one of the plurality of engagement points for reciprocal movement in opposition to the abutment; and a spring coupling the paddle cup to the paddle and biasing the paddle toward the abutment.

15. Apparatus of claim 14, further comprising:

a sidewall clip, carried by a first extremity of a sidewall, attached to the front edge of the tray; and the abutment clip attached to the sidewall clip.

16. Apparatus of claim 15, the sidewall clip comprising a first body having a first inward engagement feature coupling a first outward complemental engagement feature carried by the tray, and an opposing second inward engagement feature coupling a second outward complemental engagement feature carried by the tray.

17. Apparatus of claim 16, the paddle clip comprising a second body having a third inward engagement feature coupling the first outward complemental engagement feature carried by the tray, and an opposing fourth inward engagement feature coupling the second outward complemental engagement feature carried by the tray.

18. Apparatus of claim 17, further comprising:

the first body supporting an outward engagement feature;

the second body supporting an outward engagement feature; and the abutment clip comprising a body supporting a fifth inward complemental engagement feature concurrently coupling the outward engagement features of the first and second bodies, respectively, and a sixth inward complemental engagement feature coupling the second outward complemental engagement feature carried by the tray.

19. Apparatus of claim 14, further comprising:

the sidewall having a second extremity opposing the first extremity; and another sidewall clip, carried by the second extremity of the sidewall, attached to a rear end of the tray.

20. Apparatus of claim 14, further comprising:

the tray having opposing sides and the front edge having a length extending from one of the sides of the tray to the other of the sides of the tray; and the abutment extending along substantially the entire length of the front edge of the tray.

* * * * *